US006186064B1

(12) United States Patent
Dufour

(10) Patent No.: US 6,186,064 B1
(45) Date of Patent: Feb. 13, 2001

(54) WEB FED ROTARY PRINTING PRESS WITH MOVABLE PRINTING UNITS

(75) Inventor: Charles Henry Dufour, Durham, NH (US)

(73) Assignee: Heidelberger Druckmaschinen AG (DE)

( * ) Notice: Under 35 U.S.C. 154(b), the term of this patent shall be extended for 0 days.

(21) Appl. No.: 09/083,136

(22) Filed: May 22, 1998

(51) Int. Cl.[7] ..... B41F 5/16; B41F 5/18; B41F 7/02; B41F 13/02; B41F 5/04

(52) U.S. Cl. ..... 101/181; 101/183; 101/180; 101/217; 101/220

(58) Field of Search ..... 101/136, 137, 101/138, 139, 140, 142, 143, 144, 145, 177, 178, 179, 180, 181, 182, 183, 184, 185, 216, 217, 218, 219, 220, 221, 222, 225, 229, 247

(56) References Cited

U.S. PATENT DOCUMENTS

| | | | | |
|---|---|---|---|---|
| 1,160,444 | * | 11/1915 | Parker | 101/181 |
| 1,782,608 | | 11/1930 | Fulk . | |
| 2,140,834 | * | 12/1938 | Gazette | 101/228 |
| 2,975,706 | * | 3/1961 | Moser et al. | 101/181 |
| 4,141,293 | * | 2/1979 | Corse | 101/181 |
| 4,480,543 | * | 11/1984 | Hechler | 101/152 |
| 4,831,926 | * | 5/1989 | Bowman et al. | 101/138 |
| 4,854,231 | | 8/1989 | Jahn . | |
| 5,816,157 | * | 10/1998 | Gertsch et al. | 101/247 |
| 5,836,245 | * | 11/1998 | Bolza-Schunemann | 101/181 |

FOREIGN PATENT DOCUMENTS

| | | | |
|---|---|---|---|
| 42 19 705A1 | | 12/1992 | (DE) . |
| 44 08 027A1 | | 9/1995 | (DE) . |
| 0357530 | * | 3/1990 | (EP) . |
| 0563 007A1 | | 9/1993 | (EP) . |
| 0 664 212A1 | | 7/1995 | (EP) . |
| 0749 369B1 | | 12/1996 | (EP) . |
| 2 190 330 | | 11/1987 | (GB) . |
| 95/24314 | | 9/1995 | (WO) . |

OTHER PUBLICATIONS

European Search Report dated Sep. 3, 1999.*

* cited by examiner

*Primary Examiner*—Kimberly Asher
(74) *Attorney, Agent, or Firm*—Burns, Doane, Swecker & Mathis, L.L.P.

(57) ABSTRACT

The present invention is directed to a multicolor web fed rotary printing press having printing units that can be moved along a linear section of a web by a positioning mechanism to allow easy access to each of the printing units. The easy access to the printing units significantly reduces maintenance costs and downtime of the press. In addition, the invention provides a printing press that has a reduced overall size and allows the printing units to be arranged in a nested formation during printing operations. This nested formation reduces fanout and paper waste. The linear web section can be oriented vertically or horizontally.

20 Claims, 4 Drawing Sheets

1
2a
2b
2c
2d
4a
4b
4c
4d
6b
6y
6m
6c
26
26'
28
30

2
28
16
20
6b
10
18
6y
30
18
20
8
16
32
42
42
12
14
24
22
40
16
6m
18
6c
18
16
30
44
44

WEB FED ROTARY PRINTING PRESS WITH MOVABLE PRINTING UNITS

BACKGROUND OF THE INVENTION

1. Field of the Invention

The present invention relates generally to web fed rotary printing presses, in particular to web fed rotary printing presses for printing newspapers.

2. State of the Art

In today's commercially available web fed rotary printing presses, e.g., for producing newspapers or commercial printed products, the printing units are arranged at fixed locations in the press room and cannot be moved relative to each other in vertical directions. In huge presses such as those used for newspaper production, a plurality of printing units are arranged one above the other for printing on one or more paper webs which pass through the printing units in a substantially vertical direction. Due to the fixed arrangement of the printing units and a limited amount of space available in a press room, the printing units are not easily accessible to the press operators. As a result, substantial amounts of time are required to exchange printing plates and printing blankets and to repair and maintain the printing units.

European Patent No. EP 0 749 369 B1 describes a multi-color web fed rotary printing press, having four blanket-to-blanket printing units which are arranged one above the other and which can be separated horizontally in such a way that a press operator can enter the space provided between the blanket cylinders to exchange the printing blankets.

SUMMARY OF THE INVENTION

The present invention is directed to a web fed rotary printing press having a variety of printing units that are vertically arranged one above the other, so that each printing unit can move in vertical directions relative to the other printing units to quickly allow an operator thorough access to each printing unit.

According to a first embodiment of the invention, a web fed rotary printing press for printing a web running through the press in a substantially vertical direction includes one or more tower arrangements of printing units. In each tower, a first printing unit prints a first color onto the web, and a second printing unit prints a second color onto the web. The second printing unit is located above the first printing unit, and a lifting and positioning system or mechanism moves the first and second printing units relative to each other in a substantially vertical direction.

According to another embodiment of the invention, each tower includes three or more printing units positioned one over the other and printing different colors onto the web, each printing unit being movable in a substantially vertical direction relative to the other printing units in the tower via a lifting and positioning system or mechanism.

According to another embodiment of the invention, printing units in each tower arrangement can be moved relative to each other in groups.

Each tower can be configured so that at least two (or all) of the printing units in the tower can be moved together to rest upon each other in a nested formation.

According to another embodiment of the invention, all printing units in each tower are identical in design, and have a housing with a top surface. The top surface corresponds to a contour or shape of a bottom surface of the housing, so that when the printing units have been moved together, they are arranged in nesting formation.

According to another embodiment of the invention, one or more of the printing units in each tower can be moved below an operating floor level, on which the operator stands when performing maintenance or plate and blanket exchange. The operating floor level can be a floor of a press room, or can be a platform which is arranged above the top printing unit of each tower, or between two printing units.

Exemplary embodiments of the invention provide quick and easy access to the printing plates and printing blankets so that the press operator to quickly adjust and/or replace the printing plates and blankets and other parts as necessary. This allows the press operator to meet shorter deadlines and increases overall productivity of the press. Since the printing units are configured and oriented in the same way and operate in the same fashion, substantially all parts of each printing unit are interchangeable with those of the other printing units, and a single set of troubleshooting techniques and adjustment specifications can be used to maintain and repair the printing units. Thus, labor and parts costs associated with operating, maintaining and repairing the press can be reduced.

The present invention also confers other advantages. For example, the printing press is more compact than conventional presses of comparable performance, and requires less space. In addition, the printing units can be made using less material. This further reduces costs to manufacture the press, and also reduces a weight of the press and a required strength (and associated cost) of a floor supporting the press.

The printing units can also be moved very close together to minimize a length of a web passing through the printing units during operation of the press. Minimizing web length minimizes web wastage that occurs when starting the press. Minimizing web length also reduces fanout, i.e., lateral expansion of the web. Fanout can occur in an offset printing press when a web absorbs water from the blanket rolls and is stretched as it passes through the printing units. Accordingly, the present invention minimizes necessary fanout adjustment and control.

Another advantage of locating the printing units close together during press operation is that the operator can easily and quickly look at different parts of the printing units to check for problems that may be occurring, for example dripping ink or water. Locating the printing units close together during press operation also enhances the press operator's ability to see different parts of the printing units simultaneously. This ease of monitoring allows the operator to detect and correct malfunctions earlier, and the easy access to the printing units also encourages the operator to properly maintain the press. Consequently, the invention provides a printing press with greater production speed and production quality, and less press down time and web wastage.

BRIEF DESCRIPTION OF THE DRAWINGS

Other objects and advantages of the present invention will become apparent to those skilled in the art from the following detailed description of preferred embodiments, when read in conjunction with the accompanying drawings wherein like elements have been designated with like reference numerals and wherein.

DETAILED DESCRIPTION OF THE PREFERRED EMBODIMENTS

Figure 1:
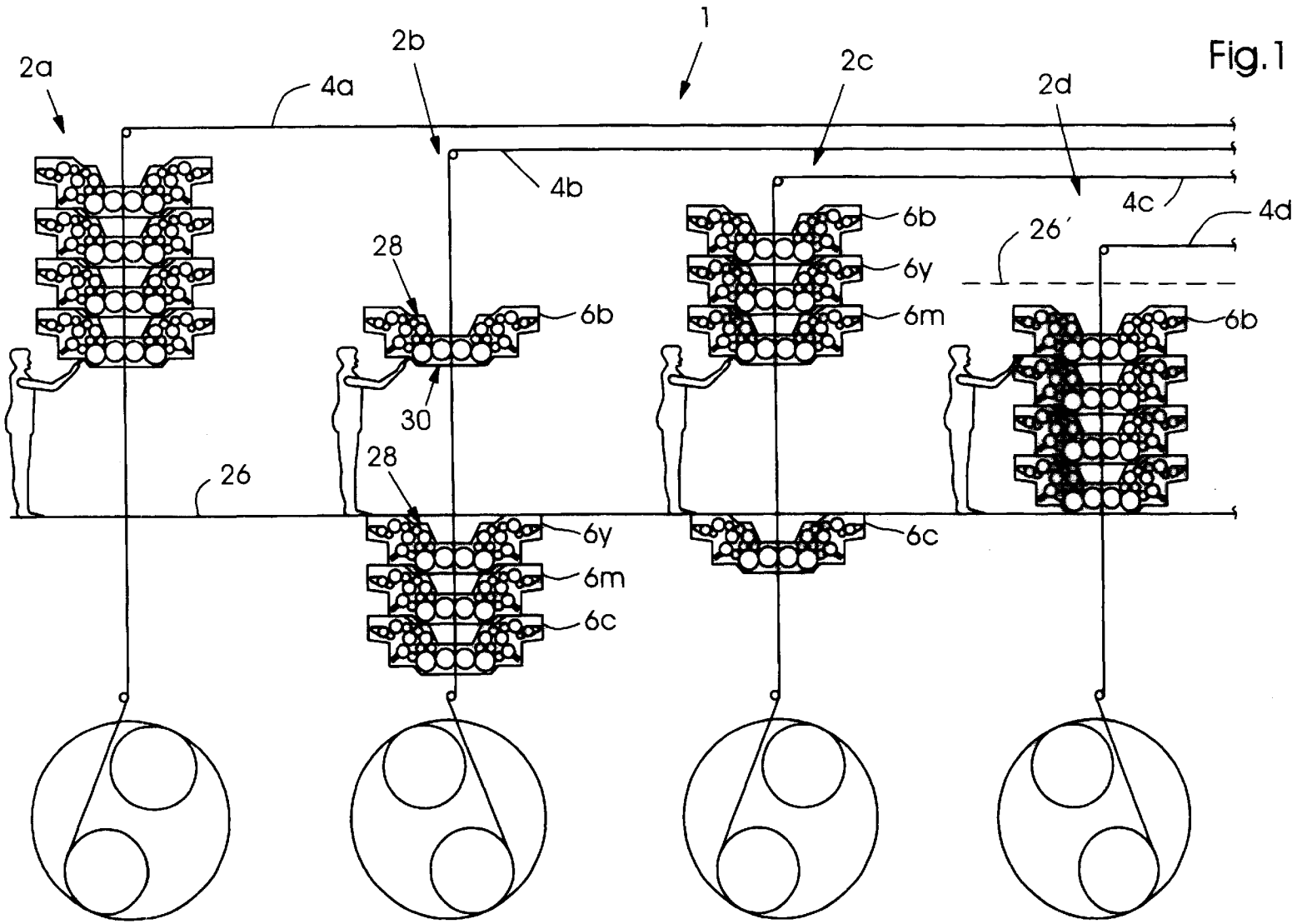
FIG. 1 is a schematic overview of a web fed rotary printing press according to the present invention, having four towers. Each tower includes four blanket-to-blanket printing units which are movable along a direction of web movement.

FIG. 1 shows a multicolor web fed rotary printing press 1 in accordance with the invention. The press 1 includes four tower arrangements 2*a*, 2*b*, 2*c* and 2*d* for printing a single color or a multicolor image on the webs 4*a*, 4*b*, 4*c* and 4*d*. The webs 4*a*, 4*b*, 4*c* and 4*d* travel in a substantially linear direction through each of the towers 2*a*–2*d*. For example, the web can travel along a substantially vertical path, as shown in FIG. 1. Alternatively, as those skilled in the art will appreciate, the web path can be in a substantially horizontal direction, or in a substantially linear path at any desired angle relative to the vertical direction shown. The towers 2*a*–2*d* each include four printing units 6*c*, 6*m*, 6*y* and 6*b* for respectively printing an image in cyan, magenta, yellow and black on both sides of each web 4*a*–4*d*. Other colors besides cyan, magenta, yellow and black can be used. The webs 4 can be, for example, between 1200 and 1600 millimeters wide.

Figure 2:
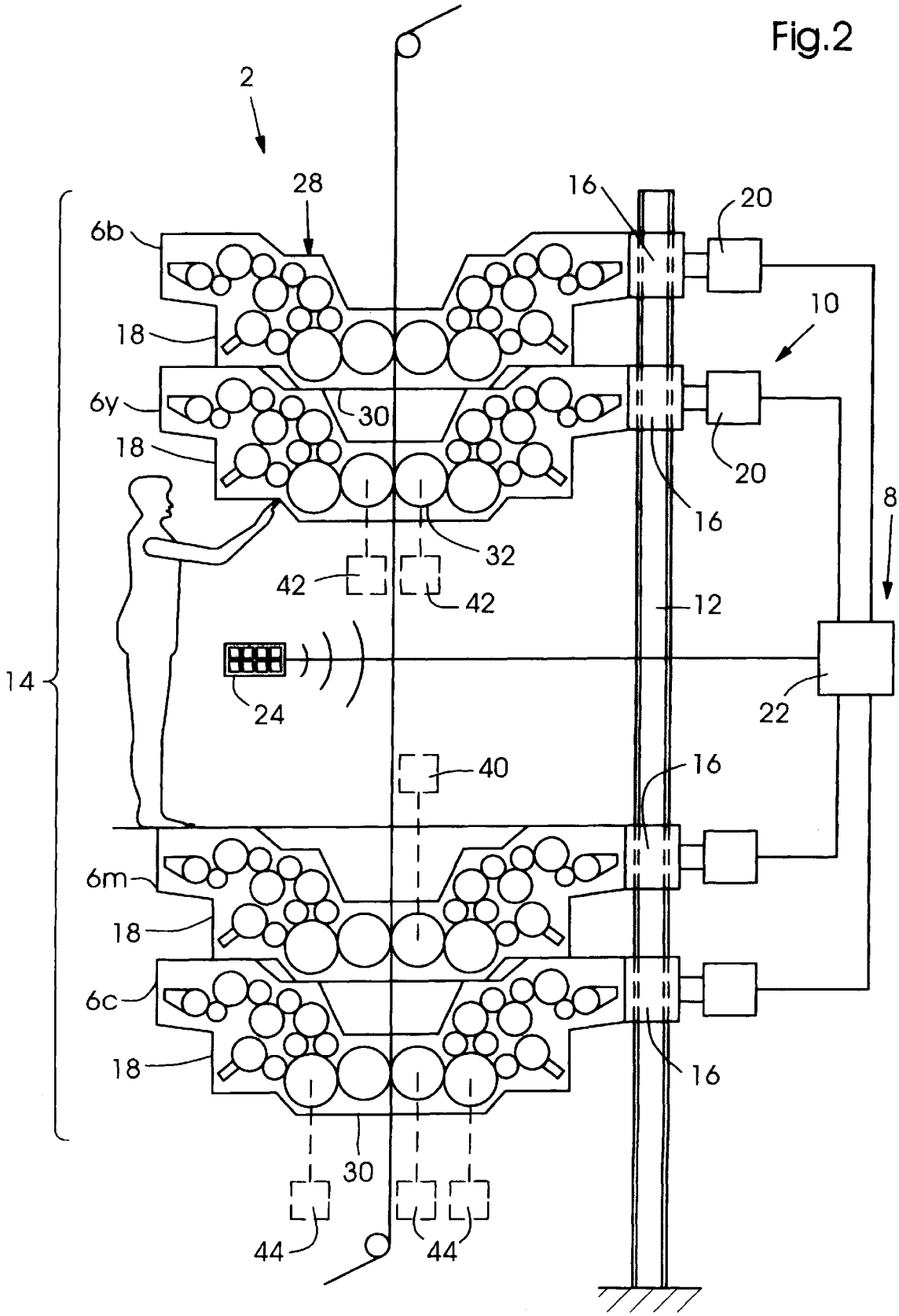
FIG. 2 is an enlarged view of a tower of FIG. 1, in which two of the printing units have been moved below the operating floor level and the operator is working on the plate cylinder of the lower printing unit of the upper pair of printing units.

Each of the printing units 6*c*, 6*m*, 6*y* and 6*b* in a tower can be moved along a respective web 4 by a lifting and positioning system 8 shown in FIG. 2. The lifting and positioning system 8 includes a spindle drive 10, which has a fixed spindle 12 spanning a range 14 over which the printing units 6*c*, 6*m*, 6*y* and 6*b* can be moved. Each of the printing units 6*c*,6*m*, 6*y* and 6*b* includes a ball screw 16, which is rotatably supported in a housing 18. The ball screw 16 can be rotated by a motor 20 as shown in FIG. 2. FIG. 2 shows one set of a spindle drive 10, fixed spindle 12, ball screws 16, and motors 20, but preferably each tower 2 is provided with several sets, one set for each corner of the print unit housing 18. The motors 20 are controlled by a motor control unit 22, which receives commands from a remote control 24. By pressing a button on the remote control 24, an operator can control the rotation of the motors 20 and thereby the movement direction and position of each printing unit 6*b*, 6*y*, 6*m* and 6*c* in a tower 2. Rail systems (not shown) fixed to a side frame of each tower 2 can also be used to precisely guide movements of the printing units 6 in the tower.

As shown in FIGS. 1 and 2, the position of each of the printing units 6 along the webs 4 and fixed spindles 12 can be controlled by the operator to allow access to a desired part of a printing unit 6. For example, in FIG. 1 the operator has moved the print unit 6*b* of tower 2*b* into a position where a printing plate of the print unit 6*b* can be most easily accessed. After the printing plate has been accessed, the operator can move the print unit 6*b* into a different position so that inker units in an upper part of the printing unit 6*b* can be easily accessed.

Two or more printing units 6 in tower 2 can also be moved as a group. For example, if the operator wants to access the plate cylinder of the printing unit 6*m* of tower 2*b* shown in FIG. 1, he can simply move the two printing units 6*y*, 6*m* upwardly together until the top surface 28 of the printing unit 6*y* contacts the bottom surface 30 of the printing unit 6*b*. Thereafter, the operator can move the group of printing units 6*b*, 6*y* and 6*m* upwards into the position shown in tower 2*c* of FIG. 1, where the plate cylinder of the printing unit 6*m* can be easily accessed.

Although FIGS. 1 and 2 show four printing units 6 for each tower 2, different numbers of printing units can be used for each tower. FIG. 1 shows that the lower three printing units 6 of the tower 2*b* are beneath an operating floor 26. Preferably at least two of the printing units can be lowered beneath the operating floor 26, and a printing press in accordance with the invention can be configured so that all of the printing units in a tower can be lowered beneath an operating floor. The operating floor can be a floor of a print shop, or can be an elevated platform. For example, the operating floor can be the platform 26' shown in FIG. 1 above the tower 2*d*.

As shown in FIG. 2, the contour or shape of the top surface 28 and the bottom surface 30 of each of the printing units 6*c*, 6*m*, 6*y* and 6*b* can be configured so that when the printing units 6 are are moved together into an operating position, the contour of the top surface 28 of one print unit matches the contour of the bottom surface 30 of the print unit above it. In other words, the printing unit housings 28 and roll and cylinder arrangements within each printing unit 6 are designed so that when the printing units 6 of a tower 2 are in an operating position they are nested together. Compact design and the nested formation of the printing units 6 allows a height of each tower 2 to be relatively small, for example, about 2.25 meters.

As shown in FIG. 2, each printing unit 6*y*, 6*m* and 6*c* in a tower 2 is preferably driven by at least one separate drive motor 40, 42 and 44, respectively. In another embodiment of the invention, as shown with respect to printing unit 6*m*, only one drive motor 40 is coupled to one of the blanket cylinders 31, and drives the other blanket cylinder 31 and associated plate cylinders 33 via a gear train (not shown).

In another embodiment of the invention, as shown with respect to printing unit 6*c* of FIG. 2, one drive motor 44 is coupled to one of the blanket cylinders 31, and drives the other blanket cylinder 31 via a gear train (not shown). Two additional, independent drive motors 44 are coupled to the associated plate cylinders 33.

In another embodiment of the invention, a separate drive motor can be coupled to each of the plate and blanket cylinders of a printing unit 6.

The drive motors can be controlled using techniques known in the art, or can be controlled using techniques such as those described in copending U.S. application Ser. No. 08/975,710, the disclosure of which is hereby incorporated by reference in its entirety.

By using at least one drive motor per printing unit, and by coupling the phase of the drive motor or drive motors 40, 42 and 44 to the phase of the motors 20 for rotating the ball screws 16, automatic register correction can be performed to maintain proper registration while moving the printing units 6*c*, 6*m*, 6*y* and 6*b* relative to each other in a vertical direction along the path of the web 4. Thus, even after two or more of the printing units 6 in a tower 2 have been moved from a nested formation (such as that of tower 2*d* in FIG. 1) to positions where printing plates on the plate cylinders can be exchanged, the printing press can be started and operated without moving the printing units 6 in the tower 2 back to the nested formation. For example, the press can be operated with printing units 6 in any of the formations shown in FIG. 1 with respect to the towers 2*a*–2*d*. Although the press can be operated with printing units 6 in a variety of formations, the preferred printing unit formation for operating the printing press is the nested formation, as shown with respect to tower 2*d* of FIG. 1. The nested formation provides the smallest fanout and can provide the shortest possible web leads, which in addition to the advantages described above, results in less paper waste, less time required to "web up", fewer platform levels, and potentially fewer press operators.

Figure 3:
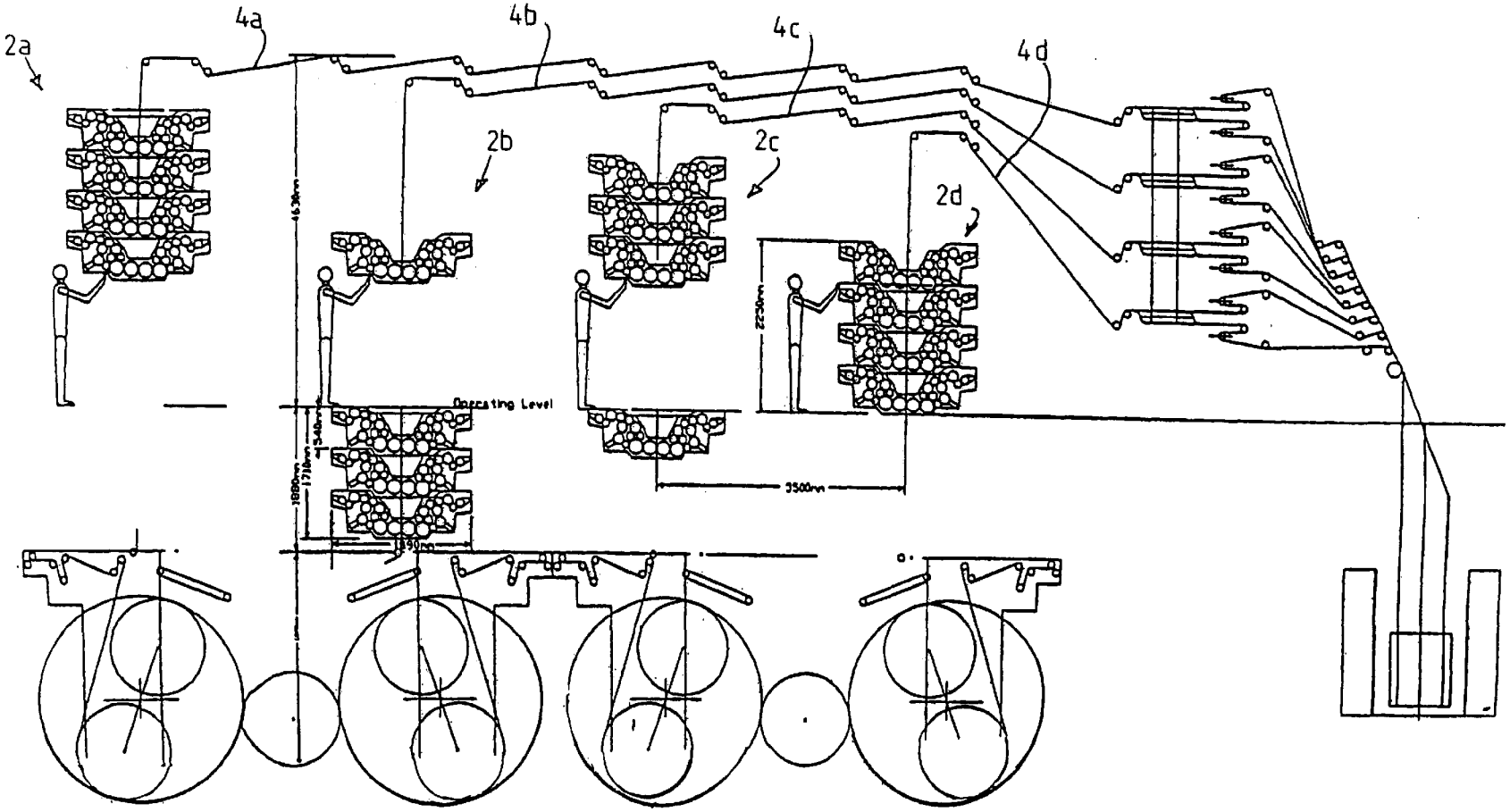
FIG. 3 is a schematic overview of a web fed rotary printing press according to the present invention, where web paths are fixed.
Figure 4:
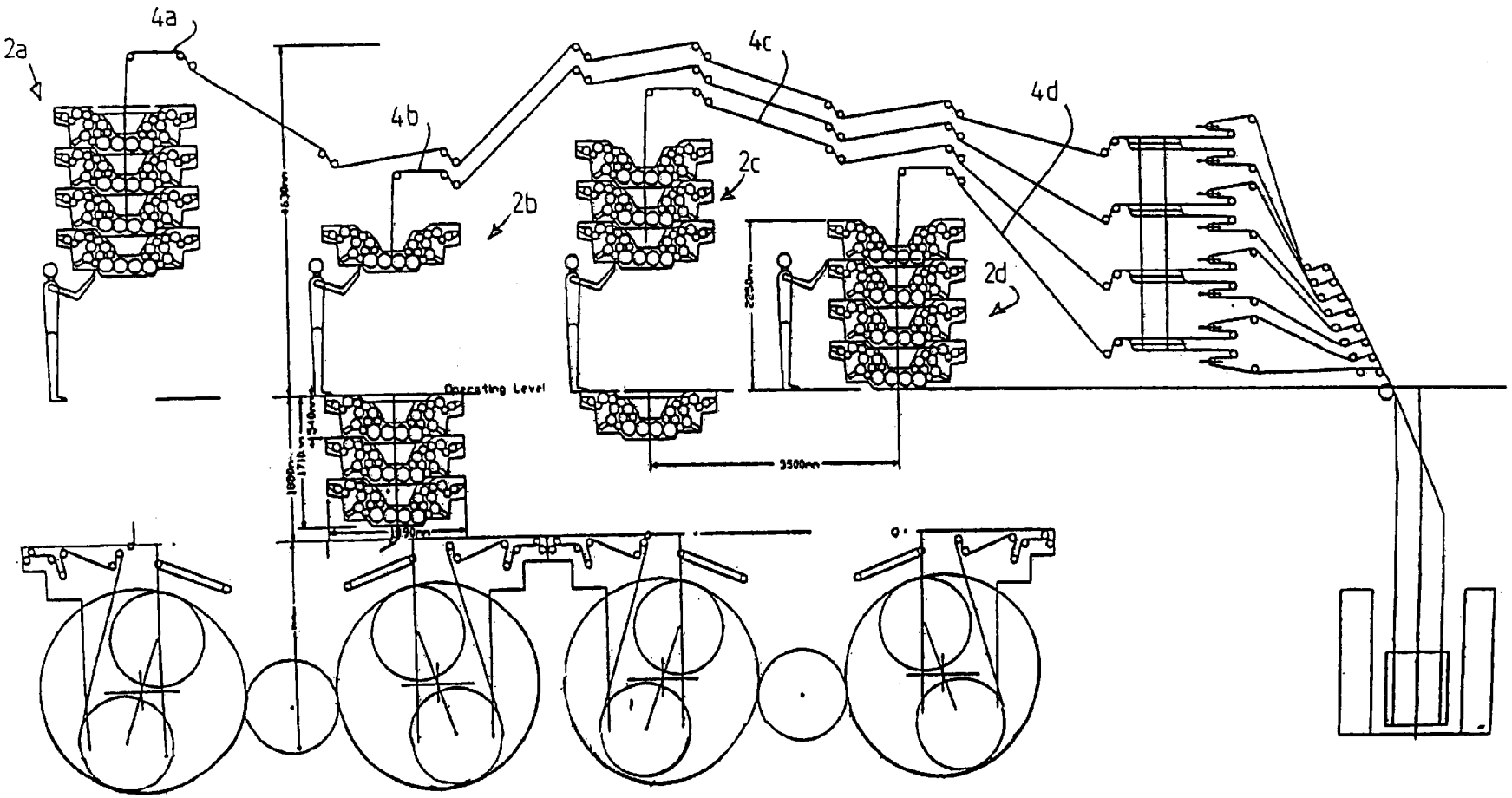
FIG. 4 is a schematic overview of a web fed rotary printing press according to the present invention, where web paths can vary with positions of printing units in the press.

In particular, web lead length and corresponding web wastage on startup can be minimized where a web path length from a paper source and through the printing units to a next operation changes with position of the printing units. For example, about 2 meters per web path can be saved. FIG. 3 shows a printing press where paths of the webs 4*a*–4*d* do not change with locations of printing units in towers 2*a*–2*d*. FIG. 4 shows a printing press where paths of the webs 4*a*–4*d* do change with locations of printing units in towers 2*a*–2*d*. For example, the web lead length of the web 4*d* in FIG. 4 is shorter than the web lead length of the web 4*d* in FIG. 3.

When the print unit drive motors 40, 42 and 44 are coupled to the motors 20 for rotating the ball screws 16, it is possible to move the printing units 6 along the web paths during operation of the printing press. However, it is necessary to automatically phase the printing unit drives so that proper registration is maintained as the printing units 6 move along paths of the webs 4 as the press operates. Automatic phasing can also be provided when the press is stopped and the printing units 6 are moved, to ensure that the printing units are properly registered when the press starts again, or to ensure that printing plate mounting slots are accessible to the operator.

To provide proper registration of the printing units 6 of a tower 2 with respect to the web 4, and to maintain proper distances and alignments between the printing units 6, locations of the printing units 6 should be known to within a predetermined tolerance. For example, in an embodiment of the invention the printing units 6 can be located with a precision of plus or minus 0.025 millimeters, or any other specified tolerance.

Different techniques and mechanisms can be used to move the printing units 6. For example, hydraulic systems or gear systems such as racks and pinions can be used. Generally, mechanisms for moving the printing units 6 can be rigid and predictable.

The printing press can also be configured so that webs move horizontally through the printing units, and the printing units are horizontally movable along the web paths.

In an embodiment of the invention, the blanket cylinders 31 of each printing unit 6 carry a sleeve shaped printing blanket 32, indicated in FIG. 2. The blanket 32 is axially removable from a body of a respective blanket cylinder 31 through an aperture (not shown) in a side wall of the housing 28, while the body of the blanket cylinder 31 is cantilevered in an opposite side wall. A blanket cylinder carrying a sleeve shaped printing blanket is described, for example, in U.S. Pat. No. 5,429,048, which is hereby incorporated by reference in its entirety.

It will be appreciated by those skilled in the art that the present invention can be embodied in other specific forms without departing from the spirit or essential characteristics thereof, and that the invention is not limited to the specific embodiments described herein. The presently disclosed embodiments are therefore considered in all respects to be illustrative and not restrictive. The scope of the invention is indicated by the appended claims rather than the foregoing description, and all changes that come within the meaning and range and equivalents thereof are intended to be embraced therein.

What is claimed is:

1. A web fed rotary printing press for printing images on a web, comprising:

a first printing unit for printing a first color on the web;

a second printing unit for printing a second color on the web; and a lifting and positioning system for moving the first and second printing units relative to each other along a path of the web;

wherein the web path is substantially linear through the printing units, and the web path is substantially vertical, and wherein each of the first and second printing units comprises at least one blanket cylinder, at least one plate cylinder associated with the at least one blanket cylinder, and at least one inker unit arranged to supply ink to the at least one plate cylinder.

2. The press of claim 1, further comprising additional printing units arranged between the first and second printing units, wherein the additional printing units are movable relative to the first and second print units along the web path.

3. The press of claim 2, wherein at least some of the printing units are formed into at least one group, and all printing units in the at least one group are commonly movable along the web path by the positioning system.

4. The press of claim 1, wherein the printing units can be moved by the positioning system to a first position where the second printing unit rests on the first printing unit.

5. The press of claim 4, wherein the printing units can be moved by the positioning system to a second position where the first and second printing units are separated from each other by a distance that allows a press operator to easily access at least one of the first and second printing units.

6. The press of claim 4, wherein each of the first and second printing units includes a housing having a bottom surface and a top surface, and the bottom surface of the second printing unit housing matches the top surface of the first printing unit housing so that the first and second printing units can be arranged in a nested formation.

7. The press of claim 6, further comprising additional printing units arranged between the first and second printing units, each having a housing, wherein adjacent surfaces of the printing units match so that the first, second and additional printing units can be arranged in a nested formation.

8. The press of claim 7, wherein at least some of the printing units are formed into at least one group, and all printing units in the at least one group are commonly movable along the web path by the positioning system.

9. The press of claim 8, wherein the first printing unit is movable to positions above and below an operating floor level.

10. The press of claim 9, wherein the second printing unit is movable to positions above and below the operating floor level.

11. The press of claim 10, wherein the operating floor level is the bottom floor of a print shop.

12. The press of claim 10, wherein the operating floor level is a platform located above the second printing unit when the printing units are in optimal printing positions.

13. The press of claim 1, wherein the lifting and positioning system comprises:

at least one spindle; and at least one position motor for each printing unit for moving the printing unit along the at least one spindle.

14. The press of claim 13, wherein the lifting and positioning system includes a remote control for individually controlling a position of each printing unit.

15. The press of claim 1, wherein each printing unit is driven by at least one separate drive motor.

16. The press of claim 15, wherein the lifting and positioning system comprises:

at least one spindle; and at least one position motor for each printing unit for moving the printing unit along the at least one spindle; wherein the drive motors and the position motors are coupled so that when the printing units are moved along the web path, a phase adjustment is automatically performed to maintain proper registration of the web and the printing units.

17. The press of claim 1, wherein a lead length of the web changes with positions of the printing units.

18. The press of claim 1, wherein each printing unit comprises at least one plate cylinder and at least one independent drive motor coupled to the at least one plate cylinder.

19. A method for accessing a web fed rotary printing press having a plurality of printing units movably arranged along a substantially linear section of a web for receiving images from the printing units, comprising the steps of:

providing the plurality of printing units each printing unit comprising at least one blanket cylinder, at least one plate cylinder associated with the at least one blanket cylinder at least one inker unit arranged to supply ink to the at least one plate cylinder, and at least one drive motor;

moving at least one of the printing units along the linear section to separate two adjacent printing units with a distance sufficient to allow access to at least one of the two adjacent printing units; and controlling the drive motors based on movement of the printing units along the web section to maintain a registration between the web and the printing units.

20. The method of claim 19, further comprising the step of moving the printing units into a nested formation, wherein the substantially linear section of the web is substantially vertical.

* * * * *